US006401871B2

(12) United States Patent
Baranda et al.

(10) Patent No.: US 6,401,871 B2
(45) **Date of Patent: *Jun. 11, 2002**

(54) TENSION MEMBER FOR AN ELEVATOR

(75) Inventors: Pedro S. Baranda; Ary O. Mello, both of Farmington, CT (US); Hugh J. O'Donnell, Longmeadow, MA (US); Karl M. Prewo, Vernon, CT (US)

(73) Assignee: Otis Elevator Company, Farmington, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/031,108

(22) Filed: Feb. 26, 1998

(51) Int. Cl.[7] ..... B66B 11/08; B66B 15/04

(52) U.S. Cl. ..... 187/254; 187/251; 187/256; 187/266; 187/264; 254/333; 254/374; 254/902; 57/231; 57/232; 474/190

(58) Field of Search ..... 187/254, 266, 187/256, 264, 414, 412, 348; 254/333, 902, 374; 474/173, 178, 190, 131; 57/231, 232

(56) References Cited

U.S. PATENT DOCUMENTS

| | | | | | |
|---|---|---|---|---|---|
| 444,447 | A | * | 1/1891 | Lieb | 474/178 |
| 582,171 | A | * | 5/1897 | Brown | 254/374 |
| 975,790 | A | | 11/1910 | Pearson | 187/254 |
| 1,011,423 | A | | 12/1911 | Gale, Sr. | 187/256 |
| 1,035,230 | A | | 8/1912 | Pearson | 187/254 |
| 1,047,330 | A | * | 12/1912 | Sundh | 187/266 |
| 1,164,115 | A | * | 12/1915 | Pearson | 187/254 |
| RE15,737 | E | * | 12/1923 | Neenan | 187/254 |
| 1,632,512 | A | * | 6/1927 | Serva | 474/178 |
| 1,748,100 | A | * | 2/1930 | Avery | 474/178 |
| 2,017,149 | A | * | 10/1935 | Greening | 474/178 |
| 2,326,670 | A | * | 8/1943 | Patterson, Jr. | 474/131 |

(List continued on next page.)

FOREIGN PATENT DOCUMENTS

| | | | | |
|---|---|---|---|---|
| DE | 2307104 A | * | 8/1973 | 187/414 |
| DE | 2333120 | | 1/1975 | |
| GB | 1362514 | | 8/1974 | |
| GB | 1401197 | | 7/1975 | |
| GB | 2116512 | * | 9/1983 | 187/254 |
| GB | 2127934 | * | 4/1984 | 474/178 |
| GB | 2134209 A | * | 8/1984 | |
| GB | 2162283 A | * | 1/1986 | |
| JP | 49-20811 B | * | 5/1974 | |
| SU | 505764 A | * | 4/1976 | |
| SU | 1216120 A | | 7/1986 | |
| SU | 1625813 | * | 2/1991 | 187/254 |
| WO | WO9829326 | | 7/1998 | |
| WO | WO9829327 | | 7/1998 | |

OTHER PUBLICATIONS

PCT Search Report for Serial No. PCT/US99/03658 dated Jun. 23, 1999.

*Primary Examiner*—Eileen D. Lillis
*Assistant Examiner*—Thuy V. Tran

(57) ABSTRACT

A tension member for an elevator system has an aspect ratio of greater than one, where aspect ratio is defined as the ratio of tension member width w to thickness t (w/t). The increase in aspect ratio results in a reduction in the maximum rope pressure and an increased flexibility as compared to conventional elevator ropes. As a result, smaller sheaves may be used with this type of tension member. In a particular embodiment, the tension member includes a plurality of individual load carrying ropes encased within a common layer of coating. The coating layer separates the individual ropes and defines an engagement surface for engaging a traction sheave.

22 Claims, 3 Drawing Sheets

U.S. PATENT DOCUMENTS 2,625,373 A * 1/1953 Hunt ..... 254/333
2,685,801 A * 8/1954 Tishman ..... 474/178
3,177,733 A * 4/1965 Yamano ..... 474/178
3,279,762 A * 10/1966 Bruns ..... 187/254
4,022,010 A * 5/1977 Gladenbeck et al. ..... 57/231
4,227,041 A * 10/1980 Den et al. ..... 174/117 F
4,388,837 A 6/1983 Bender ..... 74/89.2
4,445,593 A * 5/1984 Coleman et al. ..... 187/413
4,519,262 A 5/1985 Le et al. ..... 74/89.2
4,589,861 A * 5/1986 Dodge ..... 474/178
4,624,097 A * 11/1986 Wilcox ..... 57/232
4,724,929 A * 2/1988 Coleman et al. ..... 187/414
5,149,057 A * 9/1992 Meurer ..... 254/333
5,429,211 A * 7/1995 Aulanko et al. ..... 187/254
5,566,786 A * 10/1996 De Angelis et al. ..... 187/266
5,593,366 A * 1/1997 Puzik ..... 474/190
5,792,294 A * 8/1998 Randazzo et al. ..... 187/254 X
5,881,843 A * 3/1999 O'Donnell et al. ..... 187/254

* cited by examiner

TENSION MEMBER FOR AN ELEVATOR

TECHNICAL FIELD

The present invention relates to elevator systems, and more particularly to tension members for such elevator systems.

BACKGROUND OF THE INVENTION

A conventional traction elevator system includes a car, a counterweight, two or more ropes interconnecting the car and counterweight, a traction sheave to move the ropes, and a machine to rotate the traction sheave. The ropes are formed from laid or twisted steel wire and the sheave is formed from cast iron. The machine may be either a geared or gearless machine. A geared machine permits the use of higher speed motor, which is more compact and less costly, but requires additional maintenance and space.

Although conventional steel ropes and cast iron sheaves have proven very reliable and cost effective, there are limitations on their use. One such limitation is the traction forces between the ropes and the sheave. These traction forces may be enhanced by increasing the wrap angle of the ropes or by undercutting the grooves in the sheave. Both techniques reduce the durability of the ropes, however, as a result of the increased wear (wrap angle) or the increased rope pressure (undercutting). Another method to increase the traction forces is to use liners formed from a synthetic material in the grooves of the sheave. The liners increase the coefficient of friction between the ropes and sheave while at the same time minimizing the wear of the ropes and sheave.

Another limitation on the use of steel ropes is the flexibility and fatigue characteristics of steel wire ropes. Elevator safety codes today require that each steel rope have a minimum diameter d ($d_{min}$=8 mm for CEN; $d_{min}$=9.5 mm (⅜") for ANSI) and that the D/d ratio for traction elevators be greater than or equal to forty ($D/d \geqq 40$), where D is the diameter of the sheave. This results in the diameter D for the sheave being at least 320 mm (380 mm for ANSI). The larger the sheave diameter D, the greater torque required from the machine to drive the elevator system.

With the development of high tensile strength, lightweight synthetic fibers has come the suggestion to replace steel wire ropes in elevator systems with ropes having load carrying strands formed from synthetic fibers, such as aramid fibers. Recent publications making this suggestion include: U.S. Pat. No. 4,022,010, issued to Gladdenbeck et al.; U.S. Pat. No. 4,624,097 issued to Wilcox; U.S. Pat. No. 4,887,422 issued to Klees et al.; and U.S. Pat. No. 5,566,786 issued to De Angelis et al. The cited benefits of replacing steel fibers with aramid fibers are the improved tensile strength to weight ratio and improved flexibility of the aramid materials, along with the possibility of enhanced traction between the synthetic material of the rope and the sheave.

Even ropes formed from aramid fiber strands, however, are subject to the limitations caused by the pressure on the ropes. For both steel and aramid ropes, the higher the rope pressure, the shorter the life of the rope. Rope pressure ($P_{rope}$) is generated as the rope travels over the sheave and is directly proportional to the tension (F) in the rope and inversely proportional to the sheave diameter D and the rope diameter d ($P_{rope} \approx F/(Dd)$. In addition, the shape of the sheave grooves, including such traction enhancing techniques as undercutting the sheave grooves, further increases the maximum rope pressure to which the rope is subjected.

Even though the flexibility characteristic of such synthetic fiber ropes may be used to reduce the required D/d ratio, and thereby the sheave diameter D, the ropes will still be exposed to significant rope pressure. The inverse relationship between sheave diameter D and rope pressure limits the reduction in sheave diameter D that can be attained with conventional ropes formed from aramid fibers. In addition, aramid fibers, although they have high tensile strength, are more susceptible to failure when subjected to transverse loads. Even with reductions in the D/d requirement, the resulting rope pressure may cause undue damage to the aramid fibers and reduce the durability of the ropes.

The above art notwithstanding, scientists and engineers under the direction of Applicants' Assignee are working to develop more efficient and durable methods and apparatus to drive elevator systems.

DISCLOSURE OF THE INVENTION

According to the present invention, a tension member for an elevator has an aspect ratio of greater than one, where aspect ratio is defined as the ratio of tension member width w to thickness t (Aspect Ratio=w/t).

A principal feature of the present invention is the flatness of the tension member. The increase in aspect ratio results in a tension member that has an engagement surface, defined by the width dimension, that is optimized to distribute the rope pressure. Therefore, the maximum pressure is minimized within the tension member. In addition, by increasing the aspect ratio relative to a round rope, which has an aspect ratio equal to one, the thickness of the tension member may be reduced while maintaining a constant cross-sectional area of the tension member.

According further to the present invention, the tension member includes a plurality of individual load carrying ropes encased within a common layer of coating. The coating layer separates the individual ropes and defines an engagement surface for engaging a traction sheave.

As a result of the configuration of the tension member, the rope pressure may be distributed more uniformly throughout the tension member. As a result, the maximum rope pressure is significantly reduced as compared to a conventionally roped elevator having a similar load carrying capacity. Furthermore, the effective rope diameter 'd' (measured in the bending direction) is reduced for the equivalent load bearing capacity. Therefore, smaller values for the sheave diameter 'D' may be attained without a reduction in the D/d ratio. In addition, minimizing the diameter D of the sheave permits the use of less costly, more compact, high speed motors as the drive machine without the need for a gearbox.

In a particular embodiment of the present invention, the individual ropes are formed from strands of non-metallic material, such as aramid fibers. By incorporating ropes having the weight, strength, durability and, in particular, the flexibility characteristics of such materials into the tension member of the present invention, the acceptable traction sheave diameter may be further reduced while maintaining the maximum rope pressure within acceptable limits. As stated previously, smaller sheave diameters reduce the required torque of the machine driving the sheave and increase the rotational speed. Therefore, smaller and less costly machines may be used to drive the elevator system.

In a further particular embodiment of the present invention, a traction drive for an elevator system includes a tension member having an aspect ratio greater than one and a traction sheave having a traction surface configured to receive the tension member. The tension member includes an engagement surface defined by the width dimension of the tension member. The traction surface of the sheave and the engagement surface are complementarily contoured to provide traction and to guide the engagement between the tension member and the sheave. In an alternate configuration, the traction drive includes a plurality of tension members engaged with the sheave and the sheave includes a pair of rims disposed on opposite sides of the sheave and one or more dividers disposed between adjacent tension members. The pair of rims and dividers perform the function of guiding the engagement of the tension member with the sheave.

In another embodiment, the traction drive includes a guidance device disposed proximate to the traction sheave and engaged with the tension member. The guidance device positions the tension member for proper engagement with the traction sheave. In a particular configuration, the guidance device includes a roller engaged with the tension member and/or the sheave to define a limited space for the tension member to engage the sheave.

In a still further embodiment, the traction surface of the sheave is defined by a material that optimizes the traction forces between the sheave and the tension member and minimizes the wear of the tension member. In one configuration, the traction surface is integral to a sheave liner that is disposed on the sheave. In another configuration, the traction surface is defined by a coating layer that is bonded to the traction sheave. In a still further configuration, the traction sheave is formed from the material that defines the traction surface.

Although described herein as primarily a traction device for use in an elevator application having a traction sheave, the tension member may be useful and have benefits in elevator applications that do not use a traction sheave to drive the tension member, such as indirectly roped elevator systems, linear motor driven elevator systems, or self-propelled elevators having a counterweight. In these applications, the reduced size of the sheave may be useful in order to reduce space requirements for the elevator system. The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
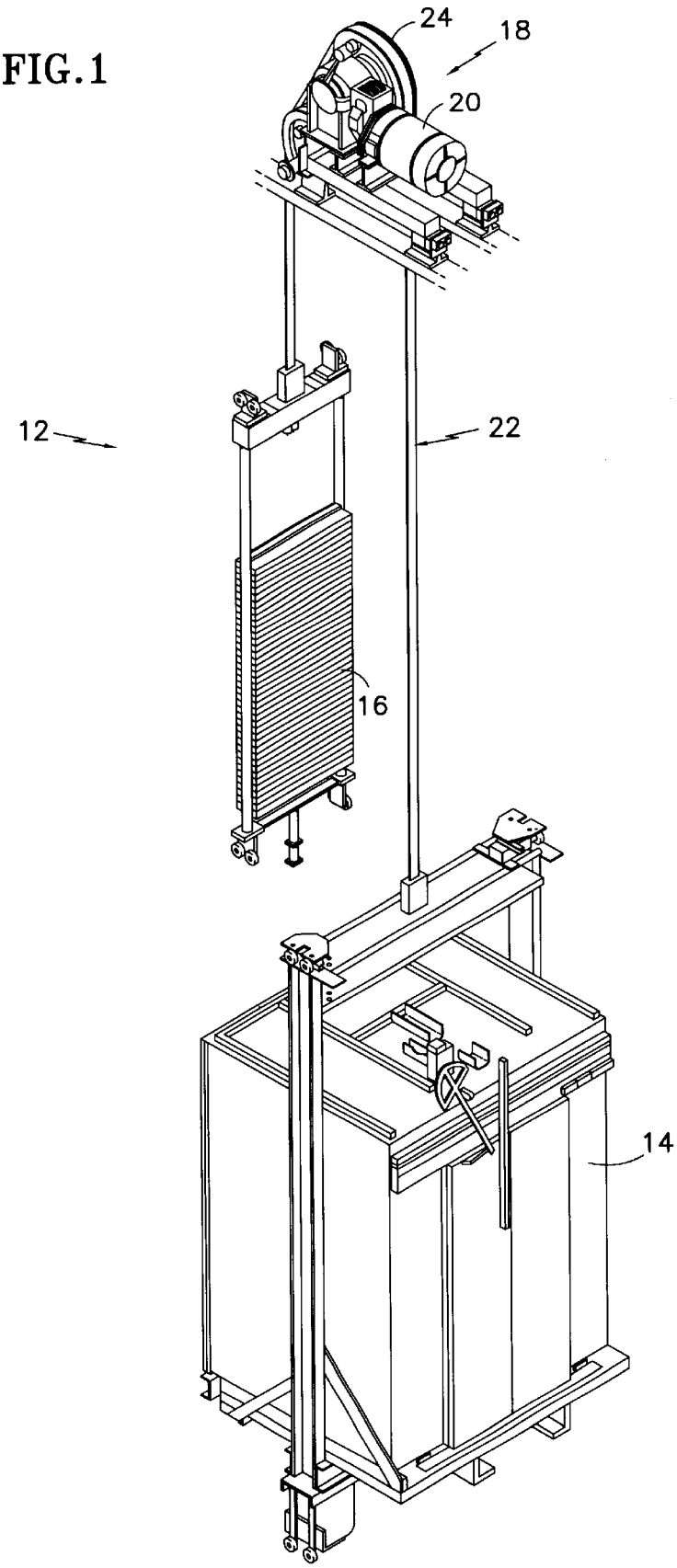
FIG. 1 is perspective view of an elevator system having a traction drive according to the present invention.

Illustrated in FIG. 1 is a traction elevator system 12. The elevator system 12 includes a car 14, a counterweight 16, a traction drive 18, and a machine 20. The traction drive 18 includes a tension member 22, interconnecting the car 14 and counterweight 16, and a traction sheave 24. The tension member 22 is engaged with the sheave 24 such that rotation of the sheave 24 moves the tension member 22, and thereby the car 14 and counterweight 16. The machine 20 is engaged with the sheave 24 to rotate the sheave 24. Although shown as an geared machine 20, it should be noted that this configuration is for illustrative purposes only, and the present invention may be used with geared or gearless machines.

Figure 2:
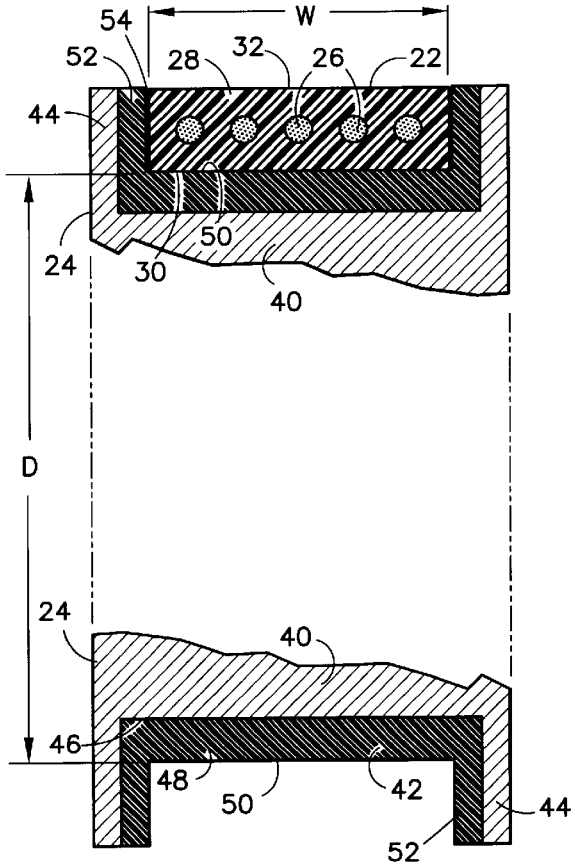
FIG. 2 is a sectional, side view of the traction drive, showing a tension member and a sheave.

The tension member 22 and sheave 24 are illustrated in more detail in FIG. 2. The tension member 22 is a single device that integrates a plurality of ropes 26 within a common coating layer 28. Each of the ropes 26 is formed from laid or twisted strands of high strength synthetic, non-metallic fibers, such as commercially available aramid fibers. The ropes 26 are equal length, are spaced widthwise within the coating layer 28 and are arranged linearly along the width dimension. The coating layer 28 is formed from a polyurethane material that is extruded onto the plurality of ropes 26 in such a manner that each of the individual ropes 26 is retained against longitudinal movement relative to the other ropes 26. Other materials may also be used for the coating layer 28 if they are sufficient to meet the required functions of the coating layer: traction, wear, transmission of traction loads to the ropes 26 and resistance to environmental factors. The coating layer 28 defines an engagement surface 30 that is in contact with a corresponding surface of the traction sheave 24.

Figure 6A:
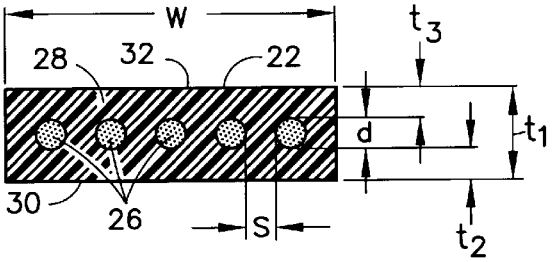
FIG. 6*a* is a sectional view of the tension member.

As shown more clearly in FIG. 6*a*, the tension member 22 has a width w, measured laterally relative to the length of the tension member 22, and a thickness t1, measured in the direction of bending of the tension member 22 about the sheave 24. Each of the ropes 26 has a diameter d and are spaced apart by a distance s. In addition, the thickness of the coating layer 28 between the ropes 26 and the engagement surface 30 is defined as t2 and between the ropes 26 and the opposite surface is defined as t3, such that t1=t2+t3+d.

The overall dimensions of the tension member 22 results in a cross-section having an aspect ratio of much greater than one, where aspect ratio is defined as the ratio of width w to thickness t1 or (Aspect Ratio=w/t1). An aspect ratio of one corresponds to a circular cross-section, such as that common in conventional round ropes 26. The higher the aspect ratio, the more flat the tension member 22 is in cross-section. Flattening out the tension member 22 minimizes the thickness t1 and maximizes the width w of the tension member 22 without sacrificing cross-sectional area or load carrying capacity. This configuration results in distributing the rope pressure across the width of the tension member 22 and reduces the maximum rope pressure relative to a round rope of comparable cross-sectional area. As shown in FIG. 1, for the tension member 22 having five individual round ropes 26 disposed within the coating layer 28, the aspect ratio is greater than five. Although shown as having an aspect ratio greater than five, it is believed that benefits will result from tension members having aspect ratios greater than one, and particularly for aspect ratios greater than two.

The separation s between adjacent ropes 26 is dependant upon the weight of the materials used in the tension member 22 and the distribution of rope stress across the tension member 22. For weight considerations, it is desirable to minimize the spacing s between adjacent ropes 26, thereby reducing the amount of coating material between the ropes 26. Taking into account rope stress distribution, however, may limit how close the ropes 26 may be to each other in order to avoid excessive stress in the coating layer 28 between adjacent ropes 26. Based on these considerations, the spacing may be optimized for the particular load carrying requirements.

The thickness t2 of the coating layer 28 is dependant upon the rope stress distribution and the wear characteristics of the coating layer 28 material. As before, it is desirable to avoid excessive stress in the coating layer 28 while providing sufficient material to maximize the expected life of the tension member 22.

The thickness t3 of the coating layer 28 is dependant upon the use of the tension member 22. As illustrated in FIG. 1, the tension member 22 travels over a single sheave 24 and therefore the top surface 32 does not engage the sheave 24. In this application, the thickness t3 may be very thin, although it must be sufficient to withstand the strain as the tension member 22 travels over the sheave 24. On the other hand, a thickness t3 equivalent to that of t2 may be required if the tension member 22 is used in an elevator system that requires reverse bending of the tension member 22 about a second sheave. In this application, both the upper 32 and lower surface 30 of the tension member 22 is an engagement surface and subject to the same requirement of wear and stress.

The diameter d of the individual ropes 26 and the number of ropes 26 is dependant upon the specific application. It is desirable to maintain the thickness d as small as possible in order to maximize the flexibility and minimize the stress in the ropes 26. The actual diameter d will depend on the load required to be carried by the tension member 22 and the space available, widthwise, for the tension member 22.

Figure 6B:
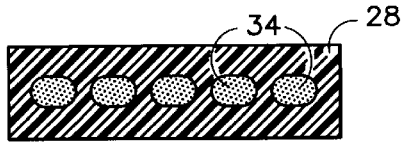
FIG. 6*b* is a sectional view of an alternate embodiment of a tension member.
Figure 6C:
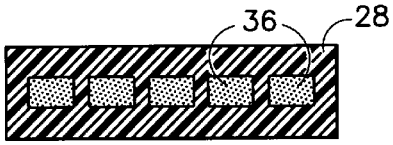
FIG. 6*c* is a sectional view of a further alternate embodiment of a tension member.
Figure 6D:
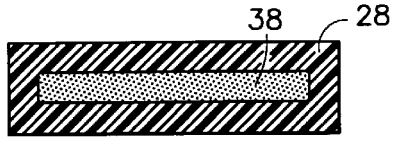
FIG. 6*d* is a sectional view of a still further embodiment of a tension member.

Although illustrated in FIG. 2 as having a plurality of round ropes 26 embedded within the coating layer 28, other styles of individual ropes may be used with the tension member 22, including those that have aspect ratios greater than one, for reasons of cost, durability or ease of fabrication. Examples include oval shaped ropes 34 (FIG. 6*b*), flat or rectangular shaped ropes 36 (FIG. 6*c*), or a single flat rope 38 distributed through the width of the tension member 22 as shown in FIG. 6*d*. An advantage of the embodiment of FIG. 6*d* is that the distribution of rope pressure may be more uniform and therefore the maximum rope pressure within the tension member 22 may be less than in the other configurations. Since the ropes are encapsulated within a coating layer, and since the coating layer defines the engagement surface, the actual shape of the ropes is less significant for traction and may be optimized for other purposes.

Referring back to FIG. 2, the traction sheave 24 includes a base 40 and a liner 42. The base 40 is formed from cast iron and includes a pair of rims 44 disposed on opposite sides of the sheave 24 to form a groove 46. The liner 42 includes a base 48 having a traction surface 50 and a pair of flanges 52 that are supported by the rims 44 of the sheave 24. The liner 42 is formed from a polyurethane material, such as that described in commonly owned U.S. Pat. No. 5,112,933 or any other suitable material providing the desired traction with the engagement surface 30 of the coating layer 28 and wear characteristics. Within the traction drive 18, it is desired that the sheave liner 42 wear rather than the sheave 24 or the tension member 22 due to the cost associated with replacing the tension member 22 or sheave 24. As such, the liner 42 performs the function of a sacrificial layer in the traction drive 18. The liner 42 is retained, either by bonding or any other conventional method, within the groove 46 and defines the traction surface 50 for receiving the tension member 22. The traction surface 50 has a diameter D. Engagement between the traction surface 50 and the engagement surface 30 provides the traction for driving the elevator system 12.

Although illustrated as having a liner 42, it should be apparent to those skilled in the art that the tension member 22 may be used with a sheave not having a liner 42. As an alternative, the liner 42 may be replaced by coating the sheave with a layer of a selected material, such as polyurethane, or the sheave may be formed or molded from an appropriate synthetic material. These alternatives may prove cost effective if it is determined that, due to the diminished size of the sheave, it may be less expensive to simply replace the entire sheave rather than replacing sheave liners.

The shape of the sheave 24 and liner 42 defines a space 54 into which the tension member 22 is received. The rims 44 and the flanges 52 of the liner 42 provide a boundary on the engagement between the tension member 22 and the sheave 24 and guide the engagement to avoid the tension member 22 becoming disengaged from the sheave 24.

Figure 3:
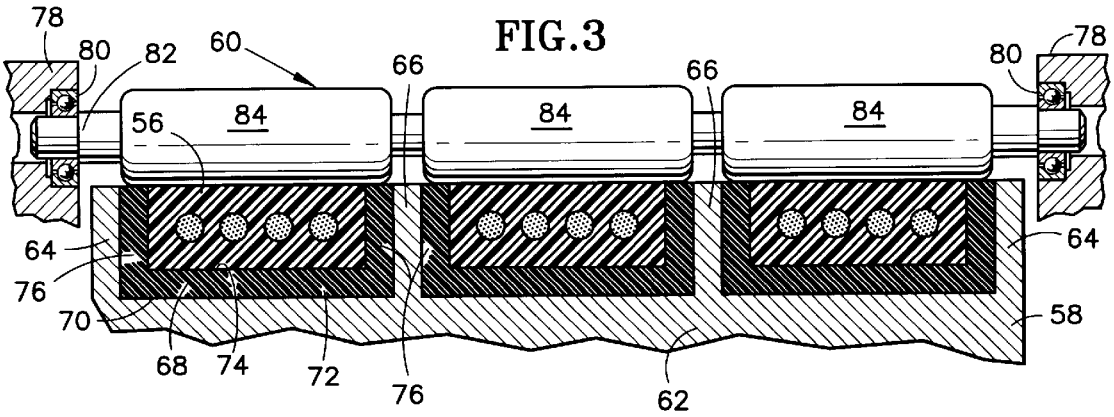
FIG. 3 is a sectional, side view of an alternate embodiment showing a plurality of tension members and a roller guide assembly.

An alternate embodiment of the traction drive 18 is illustrated in FIG. 3. In this embodiment, the traction drive 18 includes three tension members 56, a traction sheave 58, and a guidance mechanism 60. Each of the tension members 56 is similar in configuration to the tension member 22 described above with respect to FIGS. 1 and 2. The traction sheave 58 includes a base 62, a pair of rims 64 disposed on opposite side of the sheave 58, a pair of dividers 66, and three liners 68. The dividers 66 are laterally spaced from the rims 64 and from each other to define three grooves 70 that receive the liners 68. As with the liner 42 described with respect to FIG. 2, each liner 68 includes a base 72 that defines a traction surface 74 to receive one of the tension members 56 and a pair of flanges 76 that abut the rims 64 or dividers 66.

The guidance mechanism 60 is located on both sides of the sheave 58 and proximate to the take-up and take-off points for the tension member 56. The guidance mechanism 60 includes a frame 78, a pair of bearings 80, a shaft 82, and three rollers 84. The bearings 80 permit rotation of the shaft 82 and rollers 84. The rollers 84 are spaced apart such that each roller 84 is proximate to one of the grooves 70 of the sheave 58 in the region of contact with the corresponding tension member 56. The arrangement of the roller 84 and the groove 70 and liner 68 results in a limited space for the tension member 56. The space restriction guides the tension member 56 during engagement and ensures that the tension member 56 remains aligned with the traction surface 74 of the liner 68.

Figure 4:
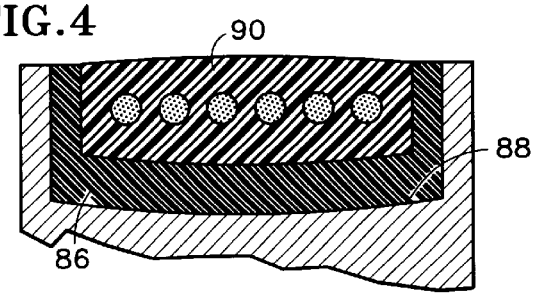
FIG. 4 is another alternate embodiment showing a traction sheave having an hour glass shape to center the tension member.
Figure 5:
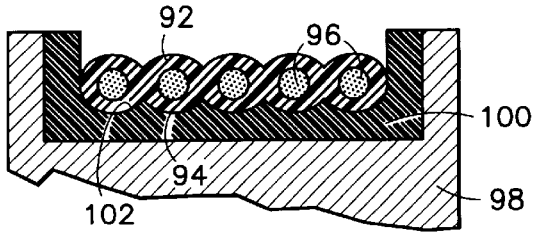
FIG. 5 is a further alternate embodiment showing a traction sheave and tension member having complementary contours to enhance traction and to guide the engagement between the tension member and the sheave.

Alternative guidance mechanisms for the traction drive 18 are illustrated in FIGS. 4 and 5. FIG. 4 illustrates a sheave 86 having an hour glass shaped traction surface 88. The shape of the traction surface 88 urges the flat tension member 90 to remain centered during operation. FIG. 5 illustrates a tension member 92 having a contoured engagement surface 94 that is defined by the encapsulated ropes 96. The traction sheave 98 includes a liner 100 that has a traction surface 102 that is contoured to complement the contour of the tension member 92. The complementary configuration provides guidance to the tension member 92 during engagement and, in addition, increases the traction forces between the tension member 92 and the traction sheave 98.

Use of tension members and traction drives according to the present invention may result in significant reductions in maximum rope pressure, with corresponding reductions in sheave diameter and torque requirements. The reduction in maximum rope pressure results from the cross-sectional area of the tension member having an aspect ratio of greater than one. For this configuration, assuming that the tension member is such as that shown in FIG. 6*d*, the calculation for maximum rope pressure is determined as follows:

$$P_{max}=(2F/Dw)$$

Where F is the maximum tension in the tension member. For the other configurations of FIGS. 6*a–c*, the maximum rope pressure would be approximately the same although slightly higher due to the discreteness of the individual ropes. For a round rope within a round groove, the calculation of maximum rope pressure is determined as follows:

$$P_{max}=(2F/Dd)(4/\pi)$$

The factor of $(4/\pi)$ results in an increase of at least 27% in maximum rope pressure, assuming that the diameters and tension levels are comparable. More significantly, the width w is much larger than the rope diameter d, which results in greatly reduced maximum rope pressure. If the conventional rope grooves are undercut, the maximum rope pressure is even greater and therefore greater relative reductions in the maximum rope pressure may be achieved. Another advantage of the tension member according to the present invention is that the thickness t1 of the tension member may be much smaller than the diameter d of equivalent load carrying capacity round ropes. This enhances the flexibility of the tension member as compared to conventional ropes.

For instance, for a sheave typical low rise gearless elevator system, the use of three tension members, each with five 3 mm aramid fiber ropes, may result in reductions in approximately fifty percent in maximum rope pressure and eighty percent in rated torque, peak torque and sheave diameter as compared to conventional steel ropes (four 10 mm SISAL core steel wire ropes) and reductions of approximately sixty percent in rated torque, peak torque and sheave diameter as compared to conventional round ropes formed from comparable aramid fibers (three 8 mm aramid fiber ropes).

Although the invention has been shown and described with respect to exemplary embodiments thereof, it should be understood by those skilled in the art that various changes, omissions, and additions may be made thereto, without departing from the spirit and scope of the invention.

What is claimed is:

1. A tension member for providing lifting force to a car of an elevator system, the tension member interconnecting the car and a counterweight, the tension member being engageable with a rotatable traction sheave that is driven by a machine and over which the tension member passes so as to engage the traction sheave between take-up and take-off points on either side of the traction sheave, the tension member comprising:

a plurality of individual load carrying ropes; and a common layer of polyurethane coating in which the ropes are embedded, maintaining separation of the individual ropes and resisting longitudinal movement of the ropes relative to one another, the tension member having a width w, a thickness t measured in the bending direction, and an engagement surface that receives force from the traction sheave as a result of traction between the engagement surface and a region of the traction sheave between the take-up and take-off points, which force is transmitted to the ropes of the tension member by the polyurethane coating to thereby move the car, the engagement surface being defined on the polyurethane coating substantially by the width dimension of the tension member, wherein the tension member has an aspect ratio, defined as the ratio of width w relative to thickness t, greater than one.

2. The tension member according to claim 1, wherein the individual ropes are formed from strands of non-metallic material.

3. The tension member according to claim 1, wherein the aspect ratio is greater than or equal to two.

4. The tension member according to claim 1, wherein the individual ropes are spaced widthwise within the common coating layer.

5. The tension member according to claim 4, wherein the plurality of individual ropes are arranged linearly.

6. The tension member according to claim 1, wherein the coating layer defines a single engagement surface for the plurality of individual ropes.

7. The tension member according to claim 6, wherein the coating layer extends widthwise such that the engagement surface extends about the plurality of individual ropes.

8. The tension member according to claim 1, wherein the engagement surface of the coating layer is shaped by the outer surface of the ropes to enhance the traction between the traction sheave and the traction member.

9. The tension member according to claim 1, wherein the engagement surface of the coating layer is shaped by the outer surface of the ropes to guide the tension member during engagement with the sheave.

10. The tension member according to claim 1, wherein the plurality of individual ropes are arranged linearly.

11. The tension member according to claim 1, wherein the individual ropes are round in cross-section.

12. The tension member according to claim 7, wherein the individual ropes have an aspect ratio, defined as the ratio of width of the individual ropes relative to thickness t of the individual ropes, greater than one.

13. The tension member according to claim 1, wherein the individual ropes are flat in cross-section.

14. A tension member for providing lifting force to a car of an elevator system, the tension member interconnecting the car and a counterweight, the tension member being engageable with a rotatable traction sheave that is driven by a machine and over which the tension member passes so as to engage the traction sheave between take-up and take-off points on either side of the traction sheave, the tension member comprising:

strands of non-metallic material; and a polyurethane coating encasing the strands, the tension member having a width w, a thickness t measured in the bending direction, and an engagement surface that receives force from the traction sheave as a result of traction between the engagement surface and a region of the traction sheave between the take-up and take-off points, which force is transmitted to the non-metallic strands of the tension member by the polyurethane coating to thereby move the car, the engagement surface being defined on the polyurethane coating substantially by the width dimension of the tension member, wherein the tension member has an aspect ratio, defined as the ratio of width w relative to thickness t, greater than one.

15. A tension member for providing lifting force to a car of an elevator system, the tension member interconnecting the car and a counterweight, the tension member being engageable with a contoured surface engagement surface of a rotatable traction sheave that is driven by a machine and over which the tension member passes so as to engage the traction sheave between take-up and take-off points on either side of the traction sheave, the tension member comprising:

a load-carrying member; and a polyurethane coating encasing the load-carrying member, the tension member having a width w, a thickness t measured in the bending direction, and an engagement surface that receive the force from the traction sheave as a result of traction between the engagement surface and a region of the traction sheave between the take-up and takeoff points, which force is transmitted to the load-carrying member of the tension member by the polyurethane coating to thereby move the car, the engagement surface being defined on the polyurethane coating substantially by the width dimension of the tension member, wherein the tension member has an aspect ratio, defined as the ratio of width w relative to the thickness t, greater than one, and wherein the engagement surface of the tension member is contoured to complement the contoured engagement surface of the sheave.

16. A tension member for providing lifting force to a car of an elevator system, the tension member interconnecting the car and a counterweight, the tension member being engageable with a rotatable traction sheave that is driven by a machine and over which the tension member passes so as to engage the traction sheave between take-up and take-off points on either side of the traction sheave, the tension member comprising:

a load-carrying member; and a polyurethane coating encasing the load-carrying member, the tension member having a width w, a thickness t measured in the bending direction, and an engagement surface that receives force from the traction sheave as a result of traction between the engagement surface and a region of the traction sheave between the take-up and take-off points, which force is transmitted to the load-carrying member of the tension member by the polyurethane coating to thereby move the car, the engagement surface being defined on the polyurethane coating substantially by the width dimension of the tension member, wherein the tension member has an aspect ratio, defined as the ratio of width w relative to thickness t, greater than one, and wherein the engagement surface is shaped to guide the tension member during engagement with the sheave.

17. A tension member for providing lifting force to a car of an elevator system, the tension member interconnecting the car and a counterweight, the tension member being engageable with a rotatable traction sheave that is driven by a machine and over which the tension member passes so as to engage the traction sheave between take-up and take-off points on either side of the traction sheave, the tension member comprising:

a load-carrying member; and a polyurethane coating encasing the load-carrying member, the tension member having a width w, a thickness t measured in the bending direction, and an engagement surface that receives force from the traction sheave as a result of traction between the engagement surface and a region of the traction sheave between the take-up and take-off points, which force is transmitted to the load-carrying member of the tension member by the polyurethane coating to thereby move the car, the engagement surface being defined on the polyurethane coating substantially by the width dimension of the tension member, wherein the tension member has an aspect ratio, defined as the ratio of width w relative to thickness t, greater than one.

18. An elevator system including:

a car;

a counterweight;

a traction sheave that is driven by a machine; and a tension member interconnecting the car and the counterweight, the tension member passing over the traction sheave, being engaged by the traction sheave between take-up and take-off points on either side of the traction sheave, and being driven by the traction sheave, the tension member comprising a plurality of individual load carrying ropes, and a layer of polyurethane coating in which the ropes are embedded, maintaining separation of the individual ropes and resisting longitudinal movement of the ropes relative to one another, the tension member having a width w, a thickness t, and an engagement surface that receives force from the traction sheave as a result of traction between the engagement surface and a region of the traction sheave between the take-up and take-off points, which force is transmitted to the ropes of the tension member by the polyurethane coating to thereby move the car, the engagement surface being defined on the polyurethane coating substantially by the width dimension of the tension member, wherein the tension member has an aspect ratio, defined as the ratio of width w relative to thickness t, greater than one.

19. An elevator system including:

a car;

a counterweight;

a traction sheave that is driven by a machine; and a tension member interconnecting the car and the counterweight, the tension member passing over the traction sheave, being engaged by the traction sheave between take-up and take-off points on either side of the traction sheave, and being driven by the traction sheave, the tension member comprising strands of non-metallic material, and a polyurethane coating encasing the strands, the tension member having a width w, a thickness t, and an engagement surface that receives force from the traction sheave as a result of traction between the engagement surface and a region of the traction sheave between the take-up and take-off points, which force is transmitted to the non-metallic strands of the tension member by the polyurethane coating to thereby move the car, the engagement surface being defined on the polyurethane coating substantially by the width dimension of the tension member, wherein the tension member has an aspect ratio, defined as the ratio of width w relative to thickness t, greater than one.

20. An elevator system including:

a car;

a counterweight;

a traction sheave having a contoured engagement surface; wherein the traction sheave is driven by a machine; and a tension member interconnecting the car and the counterweight, the tension member passing over the traction sheave, being engaged by the traction sheave between take-up and take-off points on either side of the traction sheave, and being driven by the traction sheave, the tension member comprising a load-carrying member, and a polyurethane coating encasing the load-carrying member, the tension member having a width w, a thickness t, and an engagement surface that receives force from the traction sheave as a result of traction between the engagement surface and a region of the traction sheave between take-up and take-off points, which force is transmitted to the load carrying member of the tension member by the polyurethane coating to thereby move the car, the engagement surface being defined on the polyurethane coating substantially by the width dimension of the tension member, wherein the tension member has an aspect ratio, defined as the ratio of width w relative to the thickness t, greater than one, and wherein the engagement surface is contoured to complement the contoured engagement surface of the sheave.

21. An elevator system including:

a car;

a counterweight;

a traction sheave driven by a machine; and a tension member interconnecting the car and the counterweight, the tension member passing over the traction sheave, being engaged by the traction sheave between take-up and take-off points on either side of the traction sheave, and being driven by the traction sheave, the tension member comprising a load-carrying member, and a polyurethane coating encasing the load-carrying member, the tension member having a width w, a thickness t, and an engagement surface that receives force from the traction sheave as a result of traction between the engagement surface and a region of the traction sheave between the take-up and take-off points, which force is transmitted to the load-carrying member of the tension member by the polyurethane coating to thereby move the car, the engagement surface being defined on the polyurethane coating substantially by the width dimension of the tension member, wherein the tension member has an aspect ratio, defined as the ratio of width w relative to thickness t, greater than one.

22. An elevator system including:

a car;

a counterweight;

a traction sheave driven by a machine; and a tension member interconnecting the car and the counterweight, the tension member passing over the traction sheave, being engaged by the traction sheave between take-up and take-off points on either side of the traction sheave, and being driven by the traction sheave, the tension member comprising a load-carrying member, and a polyurethane coating encasing the load-carrying member, the tension member having a width w, a thickness t, and an engagement surface that receives force from the traction sheave as a result of traction between the engagement surface and a region of the traction sheave between the take-up and take-off points, which force is transmitted to the load-carrying member of the tension member by the polyurethane coating to thereby move the car, the engagement surface being defined on the polyurethane coating substantially by the width dimension of the tension member, wherein the tension member has an aspect ratio, defined as the ratio of width w relative to thickness t, greater than one, and wherein the engagement surface is shaped to guide the tension member during engagement with the sheave.

* * * * *

US006401871C1

(12) EX PARTE REEXAMINATION CERTIFICATE (9405th)

United States Patent
Baranda et al.

(10) Number: US 6,401,871 C1
(45) **Certificate Issued: *Nov. 13, 2012**

(54) TENSION MEMBER FOR AN ELEVATOR

(75) Inventors: Pedro S. Baranda, Farmington, CT (US); Ary O. Mello, Farmington, CT (US); Hugh J. O'Donnell, Longmeadow, MA (US); Karl M. Prewo, Vernon, CT (US)

(73) Assignee: Otis Elevator Company, Farmington, CT (US)

Reexamination Request:
No. 90/011,708, May 23, 2011

Reexamination Certificate for:

| | |
|---|---|
| Patent No.: | **6,401,871** |
| Issued: | **Jun. 11, 2002** |
| Appl. No.: | **09/031,108** |
| Filed: | **Feb. 26, 1998** |

( * ) Notice: This patent is subject to a terminal disclaimer.

(51) Int. Cl.
*B66B 11/08* (2006.01)
*B66B 15/04* (2006.01)

(52) U.S. Cl. ..... 187/254; 187/251; 187/256; 187/266; 187/264; 254/333; 254/374; 254/902; 57/231; 57/232; 474/190

(58) Field of Classification Search ..... None
See application file for complete search history.

(56) References Cited

To view the complete listing of prior art documents cited during the proceeding for Reexamination Control Number 90/011,708, please refer to the USPTO's public Patent Application Information Retrieval (PAIR) system under the Display References tab.

*Primary Examiner* — Jeffrey L. Gellner

(57) ABSTRACT

A tension member for an elevator system has an aspect ratio of greater than one, where aspect ratio is defined as the ratio of tension member width w to thickness t (w/t). The increase in aspect ratio results in a reduction in the maximum rope pressure and an increased flexibility as compared to conventional elevator ropes. As a result, smaller sheaves may be used with this type of tension member. In a particular embodiment, the tension member includes a plurality of individual load carrying ropes encased within a common layer of coating. The coating layer separates the individual ropes and defines an engagement surface for engaging a traction sheave.

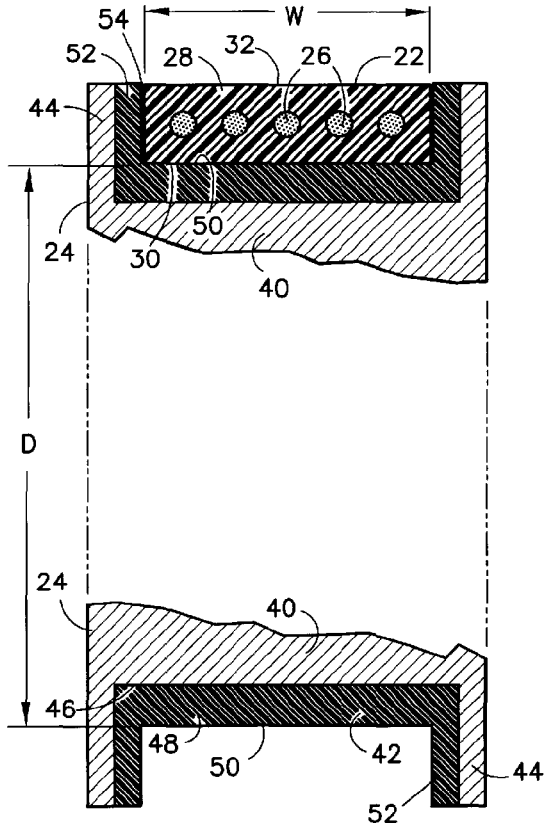

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-14, 18 and 19 is confirmed.

Claims 15-17 and 20-22 are determined to be patentable as amended.

New claims 23-44 are added and determined to be patentable.

15. A tension member for providing lifting force to a car of an elevator system, the tension member interconnecting the car and a counterweight, the tension member being engageable with a contoured surface engagement surface of a rotatable traction sheave that is driven by a machine and over which the tension member passes so as to engage the traction sheave between take-up and take-off points on either side of the traction sheave, the tension member comprising:

a load-carrying member *including a plurality of individual load carrying ropes*; and a *common layer of* polyurethane coating *in which the ropes are embedded, maintaining separation of the individual ropes and* encasing the load-carrying member, the tension member having a width w, a thickness t measured in the bending direction, and an engagement surface that receive the force from the traction sheave as a result of traction between the engagement surface and a region of the traction sheave between the take-up and takeoff points, which force is transmitted to the load-carrying member of the tension member by the polyurethane coating to thereby move the car, the engagement surface being defined on the polyurethane coating substantially by the width dimension of the tension member, wherein the tension member has an aspect ratio, defined as the ratio of width w relative to the thickness t, greater than one, and wherein the engagement surface of the tension member is contoured to complement the contoured engagement surface of the sheave.

16. A tension member for providing lifting force to a car of an elevator system, the tension member interconnecting the car and a counterweight, the tension member being engageable with a rotatable traction sheave that is driven by a machine and over which the tension member passes so as to engage the traction sheave between take-up and take-off points on either side of the traction sheave, the tension member comprising:

a load-carrying member *including a plurality of individual load carrying ropes*; and a *common layer of* polyurethane coating *in which the ropes are embedded, maintaining separation of the individual ropes and* encasing the load-carrying member, the tension member having a width w, a thickness t measured in the bending direction, and an engagement surface that receives force from the traction sheave as a result of traction between the engagement surface and a region of the traction sheave between the take-up and take-off points, which force is transmitted to the load-carrying member of the tension member by the polyurethane coating to thereby move the car, the engagement surface being defined on the polyurethane coating substantially by the width dimension of the tension member, wherein the tension member has an aspect ratio, defined as the ratio of width w relative to thickness t, greater than one, and wherein the engagement surface is shaped to guide the tension member during engagement with the sheave.

17. A tension member for providing lifting force to a car of an elevator system, the tension member interconnecting the car and a counterweight, the tension member being engageable with a rotatable traction sheave that is driven by a machine and over which the tension member passes so as to engage the traction sheave between take-up and take-off points on either side of the traction sheave, the tension member comprising:

a load-carrying member *including a plurality of individual load carrying ropes*; and a *common layer of* polyurethane coating *in which the ropes are embedded, maintaining separation of the individual ropes and* encasing the load-carrying member, the tension member having a width w, a thickness t measured in the bending direction, and an engagement surface that receives force from the traction sheave as a result of traction between the engagement surface and a region of the traction sheave between the take-up and take-off points, which force is transmitted to the load-carrying member of the tension member by the polyurethane coating to thereby move the car, the engagement surface being defined on the polyurethane coating substantially by the width dimension of the tension member, wherein the tension member has an aspect ratio, defined as the ratio of width w relative to thickness t, greater than one.

20. An elevator system including:

a car;

a counterweight;

a traction sheave having a contoured engagement surface; wherein the traction sheave is driven by a machine; and a tension member interconnecting the car and the counterweight, the tension member passing over the traction sheave, being engaged by the traction sheave between take-up and take-off points on either side of the traction sheave, and being driven by the traction sheave, the tension member comprising a load-carrying member *including a plurality of individual load carrying ropes*; and a *common layer of* polyurethane coating *in which the ropes are embedded, maintaining separation of the individual ropes and* encasing the load-carrying member, the tension member having a width w, a thickness t, and an engagement surface that receives force from the traction sheave as a result of traction between the engagement surface and a region of the traction sheave between take-up and take-off points, which force is transmitted to the load carrying member of the tension member by the polyurethane coating to thereby move the car, the engagement surface being defined on the polyurethane coating substantially by the width dimension of the tension member, wherein the tension member has an aspect ratio, defined as the ratio of width w relative to the thickness t, greater than one, and wherein the engagement surface is contoured to complement the contoured engagement surface of the sheave.

21. An elevator system including:

a car;

a counterweight;

a traction sheave driven by a machine; and a tension member interconnecting the car and the counterweight, the tension member passing over the traction sheave, being engaged by the traction sheave between take-up and take-off points on either side of the traction sheave, and being driven by the traction sheave, the tension member comprising a load-carrying member *including a plurality of individual load carrying ropes*; and a *common layer of* polyurethane coating *in which the ropes are embedded, maintaining separation of the individual ropes and* encasing the load-carrying member, the tension member having a width w, a thickness t, and an engagement surface that receives force from the traction sheave as a result of traction between the engagement surface and a region of the traction sheave between the take-up and take-off points, which force is transmitted to the load-carrying member of the tension member by the polyurethane coating to thereby move the car, the engagement surface being defined on the polyurethane coating substantially by the width dimension of the tension member, wherein the tension member has an aspect ratio, defined as the ratio of width w relative to thickness t, greater than one.

22. An elevator system including:

a car;

a counterweight;

a traction sheave driven by a machine; and a tension member interconnecting the car and the counterweight, the tension member passing over the traction sheave, being engaged by the traction sheave between take-up and take-off points on either side of the traction sheave, and being driven by the traction sheave, the tension member comprising a load-carrying member *including a plurality of individual load carrying ropes*; and a *common layer of* polyurethane coating *in which the ropes are embedded, maintaining separation of the individual ropes and* encasing the load-carrying member, the tension member having a width w, a thickness t, and an engagement surface that receives force from the traction sheave as a result of traction between the engagement surface and a region of the traction sheave between the take-up and take-off points, which force is transmitted to the load-carrying member of the tension member by the polyurethane coating to thereby move the car, the engagement surface being defined on the polyurethane coating substantially by the width dimension of the tension member, wherein the tension member has an aspect ratio, defined as the ratio of width w relative to thickness t, greater than one, and wherein the engagement surface is shaped to guide the tension member during engagement with the sheave.

*23. The tension member according to claims 1, 15, 16, 17, 18, 20, 21 or 22 wherein the ropes are about 3 mm in diameter.*

*24. The tension member according to claims 1, 15, 16, 17, 18, 20, 21 or 22 wherein the tension member has about 5 ropes.*

*25. The tension member according to claims 1, 14, 15, 16, 17, 18, 19, 20, 21 or 22 wherein the coating has a thickness ($t_2$) between the ropes and the engagement surface that engages the traction sheave.*

*26. The tension member according to claim 25, wherein the thickness between the ropes and the engagement surface is selected to avoid excessive rope stress.*

*27. The tension member according to claim 25, wherein the coating has a thickness ($t_3$) between the ropes and a surface opposite the engagement surface.*

*28. The tension member according to claim 27, wherein the thickness between the ropes and the engagement surface and the thickness between the ropes and the surface opposite the engagement surface are about the same.*

*29. The tension member according to claim 27, wherein the thickness between the ropes and the surface opposite the engagement surface is less than the thickness between the ropes and the engagement surface.*

*30. The tension member according to claim 29, wherein the thickness between the ropes and the surface opposite the engagement surface is very thin.*

*31. The tension member according to claim 29, wherein the thickness between the ropes and a surface opposite the engagement surface is selected to withstand strain as the tension member travels over the traction sheave.*

*32. The tension member according to claims 1, 14, 15, 16, 17, 18, 19, 20, 21 or 22 wherein only one of the wide sides of the coating engages the traction sheave.*

*33. The tension member according to claim 32, wherein the tension member engages a second sheave on the same wide side of the coating that engages the traction sheave.*

*34. The tension member according to claim 32, wherein the tension member engages a second sheave on the other wide side of the coating than the wide side of the coating layer that engages the traction sheave.*

*35. The tension member according to claims 1, 14, 15, 16, 17, 18, 19, 20, 21 or 22 wherein the coating completely envelopes the ropes.*

*36. The tension member according to claims 1, 14, 15, 16, 17, 18, 19, 20, 21 or 22 wherein the engagement surface is undulant.*

*37. The tension member according to claims 1, 14, 15, 16, 17, 18, 19, 20, 21 or 22 wherein the thickness of the coating across the width of the tension member varies.*

*38. The tension member according to claims 1, 14, 15, 16 or 17 wherein the tension member also suspends the car.*

*39. The tension member according to claims 1, 15, 16, 17, 18, 20, 21 or 22 wherein all of the ropes are equally spaced.*

*40. The tension member according to claims 1, 14, 15, 16, 17, 18, 19, 20, 21 or 22 wherein the tension member reverse bends about a second sheave.*

*41. The tension member according to claims 1, 14, 15, 16, 17, 18, 19, 20, 21 or 22, wherein the individual ropes include laid or twisted strands.*

*42. The tension member according to claims 1, 14, 15, 16, 17, 18, 19, 20, 21 or 22, wherein the individual ropes are round in cross-section and include laid or twisted strands.*

*43. The tension member according to claims 1, 14, 15, 16, 17, 18, 19, 20, 21 or 22, wherein the width w of the tension member is greater than total width of the plurality of individual load carrying ropes.*

*44. The tension member according to claims 1, 14, 15, 16, 17, 18, 19, 20, 21 or 22, wherein the tension member has lateral edges, and the coating has a thickness between the ropes and the lateral edges.*

* * * * *